US005467063A

United States Patent [19]

Burns et al.

[11] Patent Number: 5,467,063

[45] Date of Patent: Nov. 14, 1995

[54] ADJUSTABLE MICROWAVE POWER DIVIDER

[75] Inventors: Richard W. Burns, Orange; Darren E. Atkinson, La Habra, both of Calif.

[73] Assignee: Hughes Aircraft Company, Los Angeles, Calif.

[21] Appl. No.: 125,055

[22] Filed: Sep. 21, 1993

[51] Int. Cl.[6] ..... H01P 5/12

[52] U.S. Cl. ..... 333/125; 333/33; 333/128

[58] Field of Search ..... 333/124, 125, 333/128, 136, 33, 34, 35

[56] References Cited

U.S. PATENT DOCUMENTS

| | | | |
|---|---|---|---|
| 4,127,831 | 11/1978 | Riblet | 333/33 |
| 4,644,302 | 2/1987 | Harries et al. | 333/125 |
| 4,725,792 | 2/1988 | Lampe, Jr. | 333/128 |
| 4,901,042 | 2/1990 | Terakawa et al. | 333/128 |

FOREIGN PATENT DOCUMENTS

| | | | |
|---|---|---|---|
| 2532120 | 2/1984 | France | 333/128 |
| 0073119 | 6/1980 | Japan | 333/136 |
| 0046001 | 2/1990 | Japan | 333/33 |
| 2170358 | 7/1986 | United Kingdom | 333/128 |

OTHER PUBLICATIONS

"Split–Tee Power Divider," L. I. Parad and R. L. Moynihan, IEEE Trans, MTT, Jan. 1965, pp. 91–95.

"Coupled Strip Transmission Line Filters and Directional Couplers," E. M. T. Jones and J. T. Bolljahn, IRE Trans. MTT, vol. MTT–4, Apr. 1956, pp. 75–81.

"An Interdigitated Stripline Quadrature Hybrid," J. Lange, IEEE MTT, Dec. 1969, pp. 1150–1151.

"Hybrid Ring Directional Coupler for Arbitrary Power Divisions," C. Y. Pon, IRE Trans. MTT, Nov. 1961, pp. 529–535.

"An N–Way Hybrid Power Divider," E. J. Wilkenson, IRE Trans. MTT, Jan. 1960, pp. 116–117.

*Primary Examiner*—Benny Lee
*Assistant Examiner*—Darius Gambino
*Attorney, Agent, or Firm*—W. K. Denson-Low

[57] ABSTRACT

An adjustable microwave power divider circuit (50), providing the capability of adjusting the power division ratio after the device has been fabricated. The device includes three 90 degree transmission line networks (60, 70, 80) incorporating open transmission line stubs (66, 76, 86), two networks (70, 80) as power division networks, and the third network (60) as an input impedance matching network. A series isolation resistor (90) is connected across the outputs of the power division networks. In operation, an input signal is split between the two power division networks (70, 80) with equal voltage and phase. The power split between the two outputs is adjusted by adjusting the open stub length, thereby varying the characteristic impedance level between the two power division networks. Any signal reflected back into any one of the power divider networks is absorbed by the isolation resistor. The stub length can be trimmed after device fabrication using a laser or abrasion system.

10 Claims, 3 Drawing Sheets

ADJUSTABLE MICROWAVE POWER DIVIDER

FIELD OF THE INVENTION

The invention relates to microwave power divider circuits, and more particularly to a power divider which provides adjustable power division between the divider output ports while maintaining good isolation and input match.

BACKGROUND OF THE INVENTION

Modern phased array radars typically use thousands of radiating elements. Behind the radiators are other microwave components such as amplifiers, phase shifters, and power divider networks. The current trend in module design is to integrate a number of these microwave functions together into a common enclosure. These integrated designs save considerable production costs since they reduce the total number of parts and also eliminate the expense of testing each of the parts separately.

In the past all the modules have been made identical, with equal amplitude outputs, since this is more economical than building many different module types. Future requirements on the modules call for amplitude taper across the module in order to reduce antenna sidelobe levels.

Various types of power dividers exist to split incident power both equally and unequally, for example, split-tee couplers ("Split-Tee Power Divider," L. I. Parad and R. L. Moynihan, IEEE Trans, MTT, January 1965, pp. 91–95); coupled line couplers ("Coupled Strip Transmission Line Filters and Directional Couplers," E. M. T. Jones and J. T. Bolljahn, IRE Trans. MTT, Vol. MTT-4, April 1956, pp. 75–81); lange couplers ("An Interdigitated Stripline Quadrature Hybrid," J. Lange, IEEE MTT, December 1969, pp. 1150–1151); hybrid ring couplers ("Hybrid Ring Directional Coupler for Arbitrary Power Divisions," C. Y. Pon, IRE Trans. MTT, November 1961, pp. 529–-535); and Wilkenson couplers ("An N-Way Hybrid Power Divider," E. J. Wilkenson, IRE Trans. MTT, January 1960, pp. 116–117).

SUMMARY OF THE INVENTION

A microwave power divider circuit is disclosed for dividing an input signal into at least two output signals, wherein the power split between the output signals is adjusted after the divider circuit has been fabricated. The divider circuit comprises means for dividing the input signal into first and second signals of equal power and phase. First and second power division networks are provided, each comprising a transmission line network comprising two series-connected transmission line segments connected at a connection node and an open stub transmission line segment connected at the connection node. The open stub has a stub length, each said network characterized by a characteristic impedance determined in part by said stub length. An isolation resistor is connected across outputs of the power division networks. Typically, the divider circuit will be fabricated with identical power division circuits. To adjust the power division ratio of the divider circuit so that unequal power is delivered to the output ports, the length of one of the open stubs of the first and second power division networks is trimmed to make the characteristic impedances of the networks unequal in a ratio which provides a desired power division split of the input signal between the power division networks.

Preferably, the means for dividing the input signal also matches a composite impedance presented by the parallel connection of the power division networks to an impedance presented to the divider circuit. This dividing and matching means, in an exemplary embodiment, comprises a third transmission line network comprising two series-connected transmission line segments connected at a third connection node, and a third open stub transmission line segment connected to the third connection node. The third stub length is selected to match the composite impedance of the power division networks to the impedance presented to the power divider circuit.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
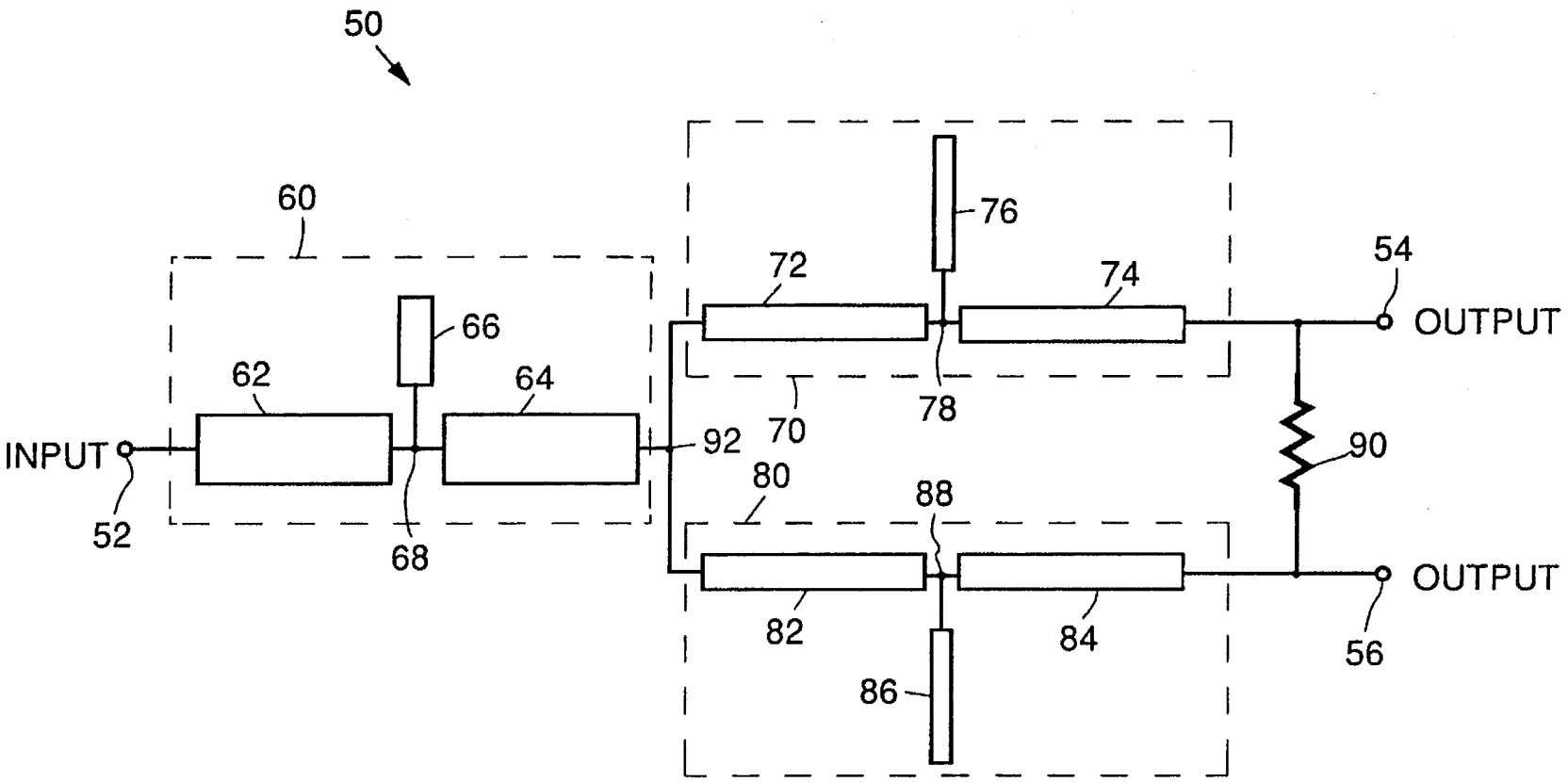
FIG. 1 is a schematic diagram of a power divider circuit in accordance with the invention.

An adjustable power divider 50 embodying this invention is shown in FIG. 1. The purpose of the device is to provide adjustable power division between the two device output ports 54 and 56 while maintaining good isolation and input match. A unique feature of this device is the ability to adjust the output power between ports after the unit has been fabricated. This feature for example reduces the cost of phased array shifter modules by adjusting for manufacturing amplitude inaccuracies in the completed units, thereby increasing the yield. Further cost savings are realized when phase shifter modules with unequal power outputs are required for amplitude tapered radar systems. This device allows all modules to be produced identically, then amplitude adjusted after manufacture.

The device 50 comprises three transmission line networks 60, 70 and 80, and an isolation resistor 90. Each network 60, 70 and 80 is a 90 degree transmission line network which incorporates an open transmission line stub, forming a quasi T-network. A T-network is typically formed using lumped components. In this device, transmission lines are substituted for these lumped elements, to form a quasi T-network with the distributed elements (transmission lines) being substituted for the normally lumped elements. Thus, network 60 comprises series-connected transmission line segments 62 and 64, and an open stub transmission line segment 66 connected at the node 68. Network 70 comprises series-connected transmission line segments 72 and 74, and an open stub 76 connected at the node 78. Similarly, network 80 comprises series-connected transmission line segments 82 and 84, and an open stub 86 connected at node 88.

Input matching network 60 is used to match the input impedance of the power division networks 70 and 80 to the impedance presented to the input port 52 of the device 50.

In operation, an input signal is passed through the network 60, and is split evenly at node 92 between the two power division networks 70, 80 with equal voltage and phase. The power ratio at the output ports 54, 56 of the device, however, is related to the relative characteristic impedance levels of the power division networks 70 and 80. If the characteristic impedance levels are the same, power will be split equally between the two outputs 54, 56, and the power at each output port will be approximately −3 dB in magnitude below the input power level. When, however, the respective characteristic impedance levels of networks 70 and 80 are different, power at the output ports 54, 56 is split in proportion to the ratio of the respective characteristic impedances, with more power being delivered to the output port associated with the lower characteristic impedance.

In accordance with a feature of the invention, the power split between the two outputs 54, 56 is adjusted after fabrication of the device by trimming the open stub length of stubs 76 and/or 86, thereby varying the characteristic impedance level between the two power division networks. Any signal reflected back into any one of the output sections is absorbed by the isolation resistor 90. Arbitrary characteristic impedance ratios, and thus power division ratios, are attainable with this invention by trimming the open stub transmission line segment in one of the power division networks 70 and 80 which are in the form of quasi T-networks. Thus, an advantage of this device over conventional power divider circuits is that the power division adjustment is accomplished after the device has been fabricated. By scribing an open stub in one of the power division networks 60, 70, an output power ratio between the two output ports 54 and 56 can be greater than 1 dB. This will be limited by bandwidth and performance specifications. Manufacturing tolerances are eased, and inaccuracies are reduced by adjusting the coupling after the unit is built. Good impedance match into the device is maintained by scribing the open stub 66 of the impedance matching network 60 as the open stub 76 or 86 of the power division network 70 or 80 is trimmed.

Trimming the stubs can be done readily with a laser setup or alternately with an abrasive system. Trimming of both the power division network stub and the matching network stub is done according to the relationships set forth in FIGS. 2 and 3. The lengths of these stubs are obtained corresponding to the desired output power ratio in dB. This output power ratio may be either 0 dB or the designed maximum ratio, or any ratio between these limits. Higher accuracy may be obtained by a trim and measure cycle that progressively approaches the desired output power ratio and input match. This will account for any manufacturing errors present in the circuit.

Any transmission line type may be used to construct a power divider network in accordance with this invention. Particular preferred embodiments are designed for use with microwave integrated circuits (MIC) and monolithic microwave integrated circuits (MMIC) which are usually fabricated in a microstrip structure for ease of assembly, and more easily trimmed since it is an open structure. Stripline can be trimmed as well, by a hole in the ground plane that would have to be provided for doing so.

Design of an embodiment of the invention in a particular application includes the following steps:

1. Determine the two characteristic impedances of the power division networks 70 and 80 for the equal and unequal power split ratios. The equal power split ratio is obtained when the two power division networks 70, 80 are identical, i.e., when both networks have the full length open stubs 76, 86 attached to the center node 78, 88, respectively. The unequal power split ratio is given by the case where one power division network has the open stub removed or disconnected from the center node. Thus, the two characteristic impedances bracket the "trim range" of the power divider, i.e., the power ratio range over which the power divider can be trimmed after fabrication by trimming an open stub of the power division networks.
2. Design the power division networks 70 and 80 to assume the characteristic impedances determined in step 1; the network with the open stub attached is designed to have the lower characteristic impedance, while the network with its open stub removed is designed to have the higher characteristic impedance.
3. Determine the necessary characteristic impedances of the input matching circuit 60 at the edges of the trim range, i.e., for the case of the equal power split, with identical power division networks 70 and 80, and for the case in which one power division network has its open stub removed. These values are determined from the two possible impedances of the parallel connected power division network input and the input impedance to the device.
4. The input matching circuit 60 is designed as in step 2 for the power division networks 70 and 80, but using the characteristic impedance levels from step 3 above.
5. The isolation resistor 90 is designed using the power split ratios at the extremities of the trim range. To provide a best isolation over all possible output power ratios over the trim range, without also trimming the resistor 90, the value of the resistor is set to the geometric mean between the two required values of resistance at each of the trim range extremes.

Design Example

The design of the device requires calculating various T-network characteristic impedance levels. These impedance levels can be determined by the following equations.

The impedance of a quasi T-network employed in the device can be calculated in the following manner. First, the input impedance $Z_{in}$ is calculated in accordance with eq. 1:

$$Z_{in}=(A-BT+JZ_0(2B-CT))/(A-BT+(J/Z_0)(2B+DT)) \quad (1)$$

where $Z_{in}$=input impedance of the device when terminated in 50 ohms; $A=1-\sin^2(\Theta_1)$; $B=(½)(\sin(2\Theta_1))$; $C=\sin^2(\Theta_1)$; $D=\cos^2(\Theta_1)$; $T=\tan(\Theta_2)$; $\Theta_1=L_1(2\pi/\lambda)$ (in Radians); $\Theta_2=L_2(2\pi/\lambda)$ (in Radians); $L_1$=length of a series connected transmission line (e.g., 72, 74) in wavelengths; $L_2$=length of the open stub transmission line (e.g., 76) in wavelengths; $\lambda$=wavelength of the propagating signal in the transmission media; $Z_O$=impedance of each of the series connected transmission lines in ohms; $J=(-1)^{1/2}$ denoting the imaginary part of the equation; and the impedance of the open stub is assumed to be 50 ohms.

The characteristic impedance $Z_t$ of the quasi T-network is then calculated by use of eq. 2:

$$Z_t=(50*Z_{in})^{1/2} \quad (2)$$

where the network is terminated in 50 ohms. This equation has been implemented in the form of FIGS. 2 and 3. These graphs show lengths of the transmission lines and stubs corresponding to the desired power split ratio extreme for a trimmable coupler designed to be implemented in a 50 ohm transmission system. Both the input matching network and the power division networks use quasi T-networks. These graphs are shown as an exemplary design aid for the quasi T-networks.

The coupler design example follows. Assume an equal power split coupler is to be designed with a maximum output power ratio of 1 dB after the power split adjustment is made. Thus, the trim range is 1 dB.

1. Determine the two characteristic impedance levels of the power division networks:

For the equal power split: (lowest network impedance required)

The impedance $Z_1$ of the power division network with the open stub attached is given by:

$$Z_1=Z_0*(1+K^2)^{1/2} \quad (3)$$

where K=the power division ratio of the higher to lower output power of the device, and equals 1 for the equal power split case; and $Z_0$=the impedance to the device terminals, typically 50 ohms. Thus, $$Z_1=50*(1+(1)^2)^{1/2}=70.71 \text{ ohms},$$

where K=1 (0 db power ratio)

For the unequal power split: (highest network impedance required)

The impedance $Z_2$ of the power division network with its open stub removed, i.e., the characteristic impedance of each of the series-connected transmission line segments comprising the power division network, is given by:

$$z_2=Z_1*K \quad (4)$$

With a 1 dB power ratio between outputs: K=10 exp(1 dB/10)=1.259; and $Z_2$=70.71, 1.259=89.02 ohms.

Figure 2:
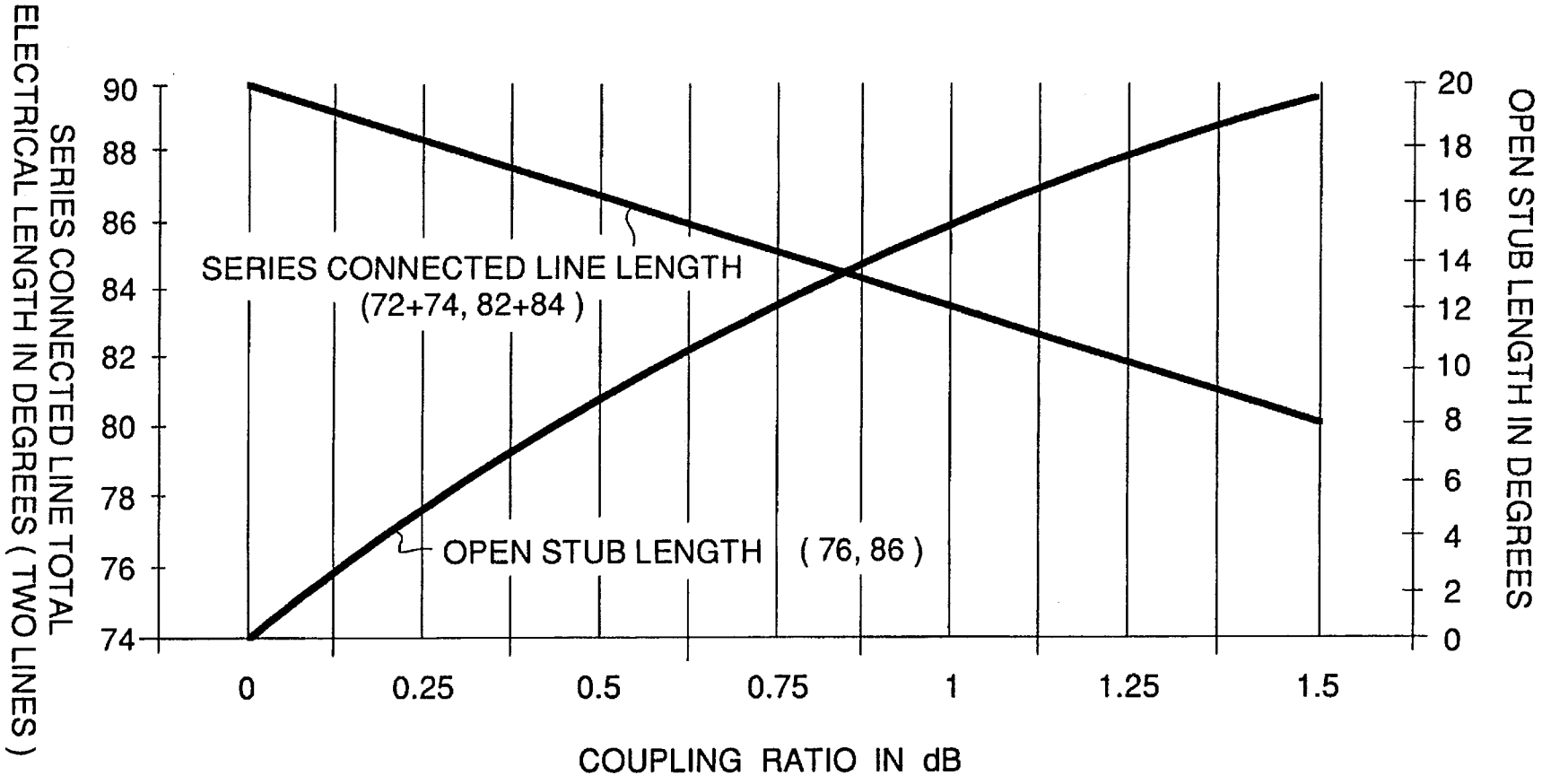
FIG. 2 is a graph relating the device coupling ratio to the series connected line segment length and the open stub length, respectively, of the power division networks 70, 80 of the device of FIG. 1.

2. Design the power division networks as quasi T-networks:

a) the series connected lines (72, 74, 82, 84) characteristic impedance is equal to $Z_2$ above;

b) the electrical length of these series connected lines is found in FIG. 2, corresponding to the 1 dB power split ratio;

c) the electrical length of the 50 ohm open stub (76 and 86) is found from FIG. 2, corresponding to the unequal power split ratio.

3. The two characteristic impedance levels of the input matching circuit $Z_3$ can be found using the relationship of eq. 5:

$$Z_3=10*K*(50/(1+K^2))^{1/2} \text{ in ohms}, \quad (5)$$

For the equal or lowest power split ratio (K=1), $$Z_{3\ (equal)}=10*1*(50/(1+1))^{1/2}=50 \text{ ohms}.$$

For the unequal or higher power split ratio: (K=1.259, 1 dB split ratio), $$Z_{3\ (unequal)}=10*1*259*((50/(1+(1.259)^2))^{1/2}=55.37 \text{ ohms}.$$

Figure 3:
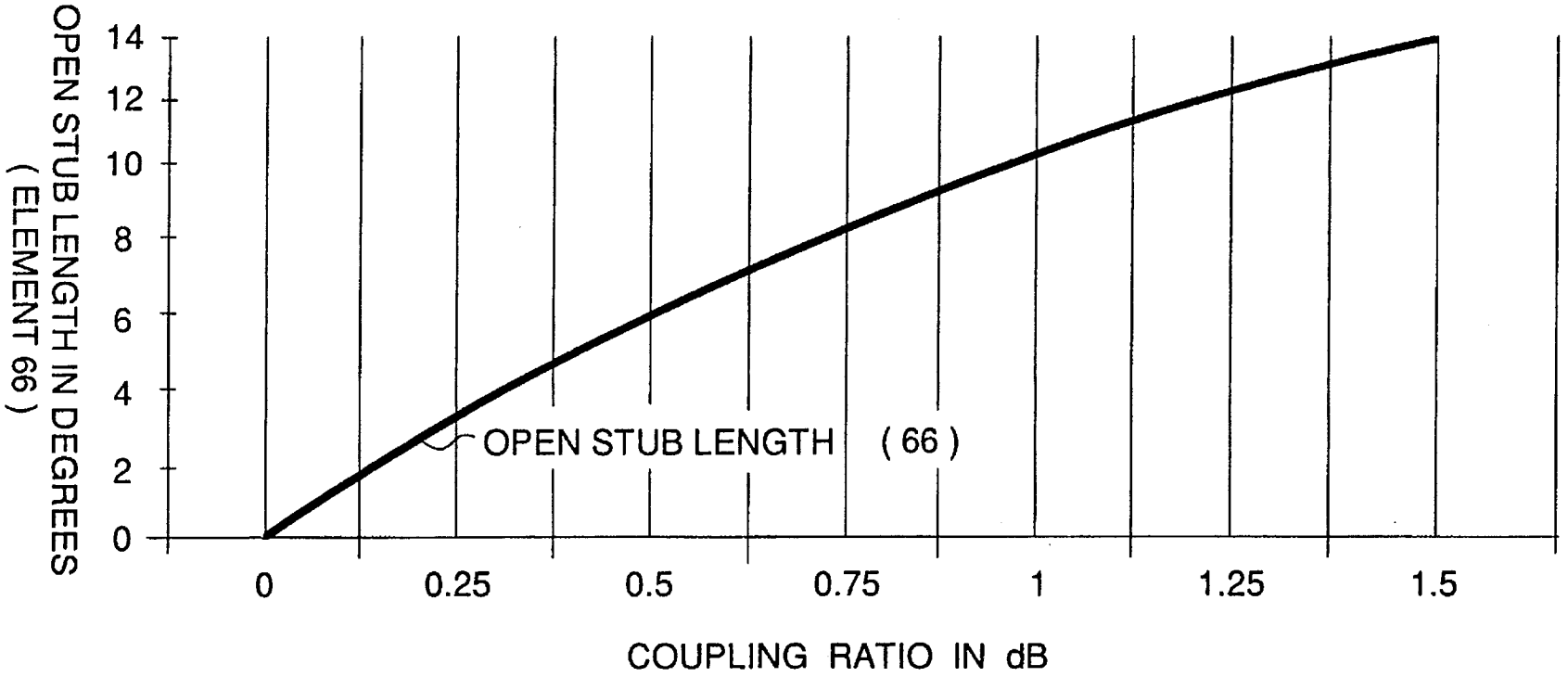
FIG. 3 is a graph relating the device coupling ratio to the open stub length of the input matching network 60 of the device of FIG. 1.

4. Design the input matching network as a quasi T-network similar to step 2 above.

a) The characteristic impedance of the series connected lines 62, 64 is equal to $Z_{3\ unequal}$.

b) The total electrical length for these series connected lines is 90° at frequency band center.

c) The electrical length of a 50 ohm open stub required to complete the T-network (10.5°, corresponding to the electrical length of the open stub required to lower the complete quasi T-network impedance of the input matching circuit to the $Z_3$ (equal) impedance level of 50 ohms from step 3 of the design example) is found in FIG. 3 corresponding to the 1 dB power split ratio design.

5. The value of the isolation resistor 90, calculated as the geometric mean of the two values of isolation resistance needed at the power split extremes as determined from the characteristic impedances of the two power division networks, and is given by the following equation:

$$R=Z_0((2*(i+K^2)/K))^{1/2} \quad (6)$$

where R=value of the isolation resistor in ohms; $Z_0$=the output impedance in which the device is terminated (50 ohms).

For K=1.259, and a 1 dB power split ratio, $$R=50*((2*(1+(1.259)^2)/1.259))^{1/2}=101.32 \text{ ohms}$$

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A microwave power divider circuit, comprising:

means for dividing an input signal into first and second signals of equal power and phase;

first and second power division networks, each comprising a transmission line network comprising two series-connected transmission line segments connected at a connection node and an open stub transmission line segment connected at said connection node, said open stub having a stub length, each said network characterized by a characteristic impedance determined in part by said stub length, said first network having a first network input port at which said first signal is received and a first network output port, said second network having a second network input port at which said second signal is received;

an isolation resistor connected across said first and second network output ports of said power division networks; and wherein said open stub lengths of said first and second power division networks are selected to provide characteristic impedances of said networks which provide a desired power division ratio of said input signal between said power division network output ports.

2. The circuit of claim 1 further comprising a power divider circuit input port and impedance matching circuit means connected at said circuit input port for matching a composite impedance presented by said power division networks to an impedance presented to said power divider circuit at said circuit input port.

3. The circuit of claim 2 wherein said impedance matching means comprises a third transmission line network comprising two series-connected transmission line segments connected at a third connection node, and a third open stub transmission line segment connected to said third connection node, said third stub having a stub length, said third network characterized by a characteristic impedance determined in part by said third stub length, said third stub length being selected to match said composite impedance to said impedance presented to said circuit.

4. The circuit of claim 1 wherein said power division networks comprise 90-degree quasi-T networks, with said respective open stub extending at approximately 90 degrees to a line extending through said series-connected transmission lines.

5. The circuit of claim 1, wherein a resistance value of said isolation resistor is set to a geometric means between required resistance values at respective extremities of a power division ratio permitted by a trimming range of said element whose length may be trimmed.

6. A microwave power divider circuit, comprising:

a power divider circuit input port;

means for dividing an input signal received at said input port into first and second signals of equal power and phase;

first and second power division networks, said first network having a first input port at which said first signal is received and a first network output port, said second network having a second network input port and a second network output port, and wherein at least one of said first and second networks comprises an element whose length may be trimmed to affect an impedance of said power division network;

an isolation resistor connected across said first and second network output ports of said power division networks;

impedance matching circuit means connected at said circuit input port for matching a composite impedance presented by said power division networks to an impedance presented to said power divider circuit at said circuit input port, said impedance matching means comprising a transmission line network comprising two series-connected transmission line segments connected at a connection node, and an open stub transmission line segment connected to said connection node, said stub having a stub length, said network characterized by a characteristic impedance determined in part by said stub length, said stub length being selected to match said composite impedance to said impedance presented to said circuit; and wherein said element length of one or more of said first and second power division networks is trimmed to provide characteristic impedances of said networks which provide a desired power division ratio of said input signal between said power division network output ports.

7. A microwave power divider circuit, comprising:

means for dividing an input signal into first and second signals of equal power and phase;

first and second power division networks, said first network having a first input port at which said first signal is received and a first network output port, said second network having a second network input port and a second network output port, wherein at least one of said first and second networks comprises an element whose length may be trimmed to affect an impedance of said power division network, and wherein said power division networks each comprise two series-connected transmission line segments connected at a connection node, and an open stub transmission line segment connected to said connection node, said stub having a stub length, said network having a characteristic impedance determined in part by said stub length, and wherein a stub length of one of said power division networks is trimmed to provide a desired power division ratio of said power divider;

an isolation resistor connected across said first and second network output ports of said power division networks; and wherein said element length of one or more of said first and second power division networks is trimmed to provide characteristic impedances of said networks which provide a desired power division ratio of said input signal between said power division network output ports.

8. A microwave power divider circuit, comprising:

means for dividing an input signal into first and second signals of equal power and phase;

first and second power division networks, said first network having a first input port at which said first signal is received and a first network output port, said second network having a second network input port and a second network output port, and wherein at least one of said first and second networks comprises an element whose length may be trimmed to affect an impedance of said power division network;

an isolation resistor connected across said first and second network output ports of said power division networks, wherein a resistance value of said isolation resistor is set to a geometric mean between respective required resistance values at respective extremities of a power division ratio permitted by a trimming range of said element whose length may be trimmed; and wherein said element length of one or more of said first and second power division networks is trimmed to provide characteristic impedances of said networks which provide a desired power division ratio of said input signal between said power division network output ports.

9. A method of fabricating a power divider circuit for dividing an input microwave signal into first and second output signals and having a desired power division ratio between said output signals, comprising a sequence of the following steps:

fabricating a power divider circuit having nominally equal power distribution between said outputs, said circuit comprising means for dividing an input signal received at a circuit input port into first and second signals of equal power and phase, first and second power division networks, each comprising an element whose length may be trimmed to affect an impedance of said power division network, said first network having a first network input port at which said first signal is received and a first network output port, said second network having a second network input port at which said second signal is received and a second network output port, and an isolation resistor connected across said first and second network output ports, and wherein said first and second output signals are taken at said first and second network output ports, and impedance matching circuit means connected at said circuit input port for matching a composite impedance presented by said power division networks to an impedance presented to said power divider circuit at said circuit input port, wherein said impedance matching means comprises a transmission line network comprising two series-connected transmission line segments connected at a connection node, and an open stub transmission line segment connected to said connection node, said stub having a stub length, said network characterized by a characteristic impedance determined in part by said stub length;

trimming said element length of said element comprising one or more of said first and second power division networks to provide characteristic impedances of said networks which provide said desired power division ratio of said input signal between said output ports; and trimming said stub length of said open stub transmission line segment to match said composite impedance to said impedance presented to said circuit.

10. A method of fabricating a power divider circuit for dividing an input microwave signal into first and second output signals and having a desired power division ratio between said output signals, comprising a sequence of the following steps:

fabricating a power divider circuit having nominally equal power distribution between said outputs, said circuit comprising means for dividing an input signal into first and second signals of equal power and phase, first and second power division networks, each comprising an element whose length may be trimmed to affect an impedance of said power division network, said first network having a first network input port at which said first signal is received and a first network output port, said second network having a second network input port at which said second signal is received and a second network output port, and an isolation resistor connected across said first and second network output ports, and wherein said first and second output signals are taken at said first and second network output ports, and wherein said power division networks each comprise two series-connected transmission line segments connected at a connection node, and said element whose length may be trimmed is an open stub transmission line segment connected to said connection node, said stub having a stub length, said network having a characteristic impedance determined in part by said stub length; and trimming said element length of one or more of said first and second power division networks to provide characteristic impedances of said networks which provide said desired power division ratio of said input signal between said output ports.

* * * * *